United States Patent [19]

Kobayashi et al.

[11] Patent Number: 4,846,098

[45] Date of Patent: Jul. 11, 1989

[54] APPARATUS FOR INTERMITTENT APPLICATION OF A COATING

[75] Inventors: Naoki Kobayashi; Sankichi Ohi, both of Tokyo, Japan

[73] Assignees: Asahi Chemical Synthetic Co., Ltd.; Melt Technical & Research Co., Ltd., Japan

[21] Appl. No.: 109,472

[22] Filed: Oct. 16, 1987

[30] Foreign Application Priority Data

Oct. 20, 1986 [JP] Japan ..... 61-247380

[51] Int. Cl.[4] ..... B05C 15/00

[52] U.S. Cl. ..... 118/300; 118/410; 141/144; 137/624.13; 137/624.15; 137/625.11

[58] Field of Search ..... 141/144; 137/624.13, 137/624.15, 625.11; 118/410, 25

[56] References Cited

U.S. PATENT DOCUMENTS

| | | | |
|---|---|---|---|
| 2,537,421 | 1/1951 | Rapp | 137/624.15 X |
| 3,273,592 | 9/1966 | Deubler et al. | 137/624.13 |
| 4,178,963 | 12/1979 | Riefler et al. | 137/625.11 X |

*Primary Examiner*—Shrive Beck
*Assistant Examiner*—Alain Bashore
*Attorney, Agent, or Firm*—Emmanuel J. Lobato; Robert E. Burns

[57] ABSTRACT

Apparatus for intermittently applying a fluid coating substance such as a workpiece or a substrate on an object such as a workpiece or a substrate. The apparatus is provided with a storage chamber to which is provided the fluid coating substance under pressure. The storage chamber has an inner rigid side provided with an orifice nozzle through which the coating substance is discharged for application. The coating substance is discharged intermittently in discrete quantitites, of minute volume if desired. The discharge is effected under control of a rotatably driven discoidal rotor in the form of a ceramic discoid disposed interiorly of the storage chamber. The discoidal rotor is provided with a through opening in the form of a cross sectional passageway extending between opposite sides thereof. The discoidal rotor has one of its sides bearing on the side of the storage chamber and as it rotates the passageway therein is intermittently aligned with and in communication with the orifice of the storage chamber. The passageway thus establishes communication periodically between the orifice and the interior of the storage chamber and the fluid coating substance is accordingly discharged under pressure as discrete small volume quantitites. The rotor is coupled to a driven shaft by a disk and universal joint constructed to maintain the rotor one side bearing closely against the rigid inner surface of the side of the storage chamber and to allow the rotor to move axially in its axis of rotation toward the orifice side of the storage chamber in response to a biasing force.

3 Claims, 1 Drawing Sheet

FIG. 1
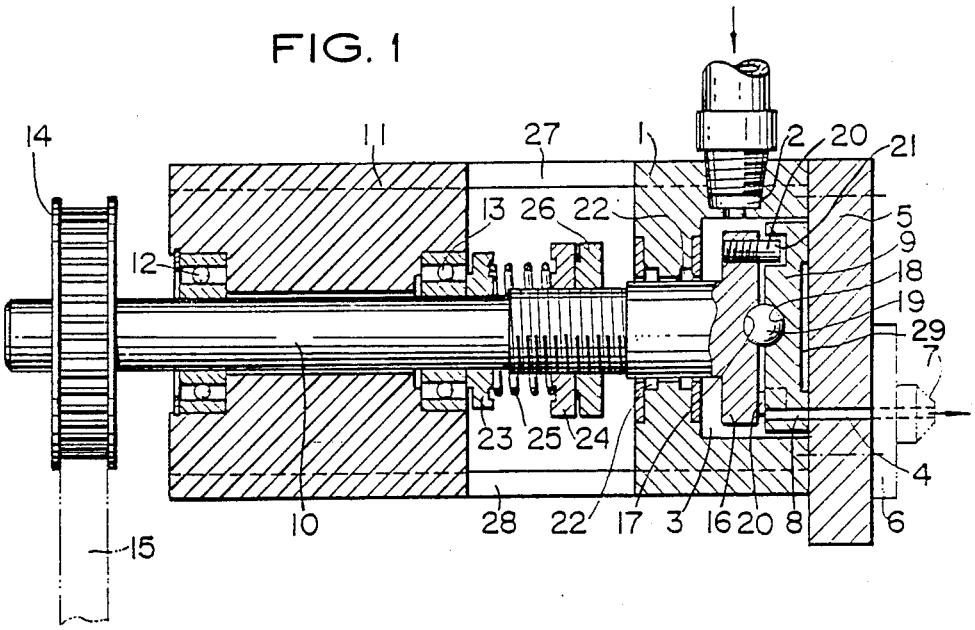
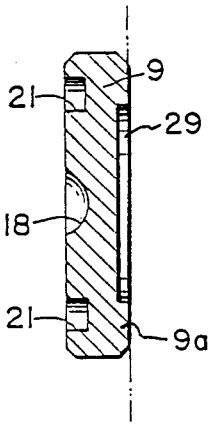
FIG. 2
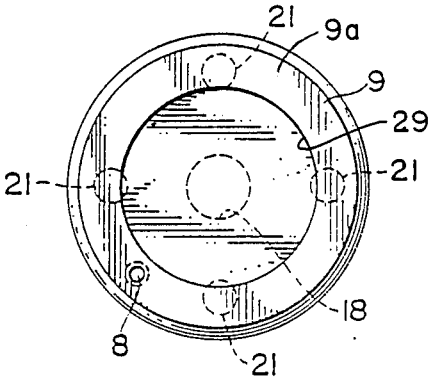
FIG. 3
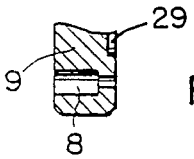
FIG. 4

APPARATUS FOR INTERMITTENT APPLICATION OF A COATING

BACKGROUND OF THE INVENTION

The invention relates to an apparatus for applying a fluid coating substance such as an adhesive, sealing material, coating material etc. and more particularly, to an apparatus for intermittently applying those coating substances to an object such as a workpiece or substrate at a high speed.

High speed intermittent application of adhesives is effective in the use of heat fused adhesives so that setting and adhesion completion time are short, based on the characteristics of the adhesive. Heat fused adhesives are used and have wide applications since there is a great need for this use. Known apparatus for intermittent application of heat fused adhesives are of many types utilizing a valve system with either needle or ball valves. In such known apparatus the valve stem, utilizing either a needle or ball, is connected to a pneumatic piston. The movement of the piston is effected by compressed air controlled by a flow control valve, and a needle or ball valve either opens or closes an orifice and the apparatus intermittently discharges heated adhesive from the orifice. Also an apparatus in which a valve stem moves up and down by electromagnetic force of solenoids instead of compressed air is known, and it controls the opening and closing of the orifice.

However, it is known these apparatus are inadequate for high speed operational requirements which are now needed and there are also the same type problems on the maintenance thereof. By using the above known valve system, discharge and stopping are repeated at high speed. The result is an intermittent discharging time which is controllable within 15/1000 second minimum and the maximum repetitive limit per minute is about 300 times. Moreover, the use of compressed air becomes a source of noise due to repeated sound resulting from the flow control valve. Furthermore since a supply source for compressed air is necessary, the apparatus is complicated. In controlling the known apparatus by using electromagnetic force, it is difficult to obtain satisfactory operation at high speeds. Especially, heat fused adhesives must be heated, so this heating has a negative influence on the operation of solenoids. Thus there are constructional defects in such apparatus. There are other known apparatus for intermittent application such as a gravure roll coater, stack coater, stamp coater etc., but these also have many problems when in use in comparison to the above mentioned valve system in relation to high speed intermittent application of an adhesive, the practical application of applying a pattern, the precision of amount applied and the like.

SUMMARY OF THE INVENTION

It is an object of the present invention to provide an apparatus for intermittently applying a coating substance at a high speed to a workpiece or a substrate without need of compressed air or use of a solenoid.

It is another object of the invention to provide an apparatus for intermittently applying fluid coating substance which is particularly advantageous in high speed intermittent application. No leaking of coating substance occurs, and discharge time during application is shortened. Moreover, the discharging of micro quantities is possible.

In order to attain the above objectives, the invention provides an apparatus for intermittent application comprising a storage chamber for receiving a coating substance. A plate is provided at one side of the storage chamber and has an orifice. A rotor is disposed in close proximity and rotatable relative to the plate and it has a passage brought into alignment with the orifice.

The other objects and features of this invention may be understood by referring to the drawings attached hereto.

BRIEF DESCRIPTION OF THE DRAWINGS

FIG. 1 is a longitudinal cross sectional view of an apparatus for intermittent coating substance application, according to the invention;

FIG. 2 is a cross sectional view of a rotor in FIG. 1;

FIG. 3 is a front view of the rotor in FIG. 2;

FIG. 4 is a cross sectional view of an orifice provided on the rotor.

DESCRIPTION OF THE PREFERRED EMBODIMENTS

In the drawings, an application apparatus has a head 1 having an inlet 2 for inflow of a fluid coating substance such as an adhesive etc, and a storage chamber 3 for receiving the coating substance. A hose or conduit is connected to the inlet and the coating substance is supplied from a supply source through the hose by means of a pump. The pressure of the fluid coating substance in the storage chamber is adjusted by inflow thereof into the storage chamber. At one side of the storage chamber 3 a plate 5 having an orifice 4 is fixed. The orifice 4 is aligned with a nozzle 7 provided within a nozzle adapter 6. Depending upon the purpose a wide nozzle such as a T-type die or various other types of nozzle may be utilized.

Toward the inside outer portion of the plate 5 a rotor 9 having a cross sectional passage 8 through which the coating substance flows outwardly is rotatably provided. The rotor 9 is substantially housed internally of the storage chamber 3 and is disposed so that the passage 8 periodically coincides with the orifice 4 of the plate 5 when the rotor rotates. In the drawings, only one passage 8 of the rotor 9 is shown but two or more may be provided.

The rotor slides against the plate 5 in close proximity therewith and, therefore, it is preferable to make the rotor of an abrasion-resistance material. An example, shown in the drawings, is made of ceramics but other suitable materials may be utilized. A rotary driven shaft, 10 which rotates the rotor 9, is supported on a base 11 by bearings 12 and 13 and is driven by a pulley 14 which is located and secured at one end of the shaft. A motor (not shown) rotates the pulley by means of a driver belt 15. At the other end of the rotary shaft 10 a disk 16 is provided. The disk 16 is engaged with the rotor 9 by means of a suitable universal joint so that the rotor may rotate in close fixed proximity with the plate. By means of this universal joint, the rotor is always in close proximity to the plate, even if deviation occurs in the axial direction of the rotary shaft. As for the universal joint, many types may be considered.

In the drawing, recesses 17 and 18 are formed at the center of each of the disk 16 and rotor 9 and a ball 19, such as a steel ball etc, is placed thereinto. The ball is held between the disk 16 and the rotor 9. By providing pins 20 on the disk peripherally of the ball, the disk and rotor are coupled and connected so that movement in the longitudinal direction of the rotary shaft may be possible. The pins 20 are studded into the disk 16 and the head portion thereof are engaged with holes 21 provided in the rotor 9. It is optional to provide the pins 20 in the rotor 9, and the holes 21 on the disk 16. Between the rotary shaft 10 and the head 1 a labyrinth packing or other suitable packing 22 is provided and the axis is thereby sealed to prevent extrusion of the coating substance.

To permit the rotation of the rotor in close proximity with the plate without separation from it, push or thrust means is provided to press the rotor to the side plate 5. In the drawings, the thrust means biases the rotary axis 10 in the direction of the rotor by inserting a spring 25 between a seat 23, which is provided on the side surface of the bearing 13, and a nut 24 which is screwed at the middle portion of the rotary shaft 10. This bias operation may be adjusted by rotating the nut 24 and a lock not 26 located adjacently and threaded. As mentioned above, due to providing the storage chamber 3 in the head 1 and providing the rotor 9 along the plate 5, transport pressure of the coating substance such as adhesive etc. which is transported from the supply source by means of a pump operates directly to bias the rotor. Thus it makes possible to push the rotor in the same direction as the bias direction of the spring. Thus it is possible to make the push pressure of the spring 25 small and if desired, the spring may be omitted. Due to the pushing or biasing of the rotor toward the plate, outflow of the coating substance from the periphery of the rotor to the orifice 4 of the plate 5 is prevented.

The head 1 and the base 11 are connected with proper connecting plates 27 and 28. If the coating substance is adhesive such as a hot melt and the like, it is preferable to control the temperature by providing heat means (not shown) utilizing a band heater and a bar heater etc. on either or both of the head and plate as well as a heat controller (not shown) at an appropriate place. The rotor 9 is rotated at very high speeds. The motor 9 is provided with a central recess 29 so that only an annular marginal surface 9*a* bears against the head end plate 5. The reduced annular contact surface makes it easier to rotate the rotor.

When the passage 8 is aligned with the plate orifice 4 in rotating, the coating substance such as adhesive etc. which enters through the inlet 2 to the storage chamber 3 passes through the passage 8 of the rotating rotor 9, and is discharged from the nozzle 7 provided on the plate 5 through the orifice 4, and is applied to the workpiece or substrate (not shown). Discharge and stopping of the coating substance are controlled by the number of passages 8 on the rotor and the plate orifice 4 each of the opening areas and the rotary speed of the rotor. As the rotor is pushed by the thrust means, the direct outflow into the nozzle from periphery of the rotor can be prevented and reliable control is accomplished. Further, when the above workpiece or substrate is moved by a conveyor belt etc, or the workpiece is in film or sheet form and such film is moving, the coating substance is discharged intermittently from the nozzle and is applied to the workpiece by controlling the rotor to correspond to the speed of motion or travel of the workpiece. In case of intermittent application of adhesive, it is possible to apply it at a high rate of speed, 600 times per minute and the minimum time for discharge can be shortened to about 2/1000 second.

In the above embodiment, the application of an adhesive is mainly explained, but this invention can also be applied to other proper coating substances such as coating or sealing materials.

This invention is constitued as mentioned above and adopts the application of rotary system. Therefore, the high speed intermittent application described becomes possible, discharge time is shortened, micro quantity discharge becomes possible, waste of the adhesive is avoided, its construction is simple, and the operation is carried out noiselessly and effectively.

What we claim is:

1. Apparatus for intermittent application of a fluid coating substance on an object comprising, means for defining a storage chamber for containing under pressure a fluid coating substance to be applied to an object, means for defining an inner ridge surface on a side of the storage chamber and having a through orifice in communication with the interior and the exterior of said storage chamber for intermittent discharge of discrete quantities of said fluid coating substance under pressure to the exterior of the storage chamber, means internally of said storage chamber for controlling supplying to said orifice said discrete quantities of the fluid coating substance comprising a rotatably driven discoidal rotor having a peripheral annular side surface in close contact with said rigid surface and a cross sectional through opening through said peripheral annular surface for periodically establishing communication between the orifice and the interior of said storage chamber through said through opening for intermittent discharge under pressure of said discrete quantities of the fluid coating through said orifice, the driven rotor having an axis of rotation, said through opening thereof being disposed in said annular side surface to register in alignment with said orifice intermittently during rotation of the rotor for effecting discharge of said fluid coating substance under pressure through said orifice, means defining an inlet tube into said storage chamber for supplying fluid coating substance into the storage chamber under pressure for effectively applying a lateral biasing force on the rotor to bias said annular side surface thereof into close contact with said rigid surface, driven means variably operable at high speeds for driving said rotor comprising coupling means for coupling to the rotor for drive thereof, and the coupling means and rotor having means for effectively coupling the rotor and for allowing it to move axially of its axis of rotation in a direction laterally toward said rigid surface under effect of the fluid coating substance provided under pressure.

2. Apparatus for intermittent application of a fluid coating substance on an object according to claim 1, in which said driven means comprises a driven shaft, a disk on said shaft opposed to said discoidal rotor, said coupling means comprising a universal coupling having a ball between the disk and discoidal rotor to allow the shaft and discoidal rotor axis to be relatively canted, and pins extending axially between the disk and discoidal rotor coupling for rotation of the disk to the discoidal rotor and allowing relative movement of the discoidal rotor axially of its axis of rotation.

3. Apparatus for intermittent application of a fluid coating substance on an object according to claim 2, further including a spring biasing the shaft axially for applying an axial force on said disk toward said rigid surface.

* * * * *